US010211548B2

(12) United States Patent
Willems et al.

(10) Patent No.: US 10,211,548 B2
(45) Date of Patent: Feb. 19, 2019

(54) PATCHBOARD

(71) Applicant: Phoenix Contact GmbH & Co. KG, Blomberg (DE)

(72) Inventors: Marcel Willems, Blomberg (DE); Jürgen Brand, Detmold (DE); Ralph Hoppmann, Bad Oeynhausen (DE); Christian Kloppenburg, Büren Wewelsburg (DE); Kevin Berghahn, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/565,527

(22) PCT Filed: Apr. 8, 2016

(86) PCT No.: PCT/EP2016/057709

§ 371 (c)(1),
(2) Date: Oct. 10, 2017

(87) PCT Pub. No.: WO2016/162462

PCT Pub. Date: Oct. 13, 2016

(65) Prior Publication Data

US 2018/0131107 A1 May 10, 2018

(30) Foreign Application Priority Data

Apr. 10, 2015 (DE) ..... 10 2015 105 548

(51) Int. Cl.
*H01R 9/24* (2006.01)
*H01R 9/26* (2006.01)

(52) U.S. Cl.
CPC ..... *H01R 9/2408* (2013.01); *H01R 9/2608* (2013.01); *H01R 9/2675* (2013.01)

(58) Field of Classification Search
CPC ..... H01R 13/514; H01R 13/506; H01R 13/6275; H01R 13/6335; H01R 13/6272;
(Continued)

(56) References Cited

U.S. PATENT DOCUMENTS 4,425,018 A 1/1984 Stenz
5,507,077 A * 4/1996 Kotajima ..... H02G 3/105 24/669

(Continued)

FOREIGN PATENT DOCUMENTS

DE 195 12 226 A1 10/1996
DE 10 2013 101 830 A1 7/2014

(Continued)

*Primary Examiner* — Truc Nguyen
(74) *Attorney, Agent, or Firm* — David S. Safran; Roberts Mlotkowski Safran Cole & Calderon, P.C.

(57) ABSTRACT

A patchboard having a plurality of socket blocks (2), each of which has a box-like housing (3) with two end faces (4*a*, 4*b*) and four side faces (5*a*, 5*b*, 5*c*, 5*d*) which extend between the end faces (4*a*, 4*b*), the two end faces (4*a*, 4*b*) of the socket blocks (2) having at least one connection region (6). An increased degree of flexibility and ability to adapt to individual user requests is achieved due to each of at least two side faces (5*a*, 5*b*, 5*c*, 5*d*) of the socket blocks (2) having at least one latching element for connection to another socket block (2), and by at least one termination element (11) being arranged on at least one side of the patchboard (1), the termination element (11) having a mating latching element on at least one side face (12, 12*b*) for connecting the termination element to an adjacent socket block (2).

13 Claims, 9 Drawing Sheets

(58) Field of Classification Search
CPC .. H01R 2201/26; H01R 25/006; H01R 11/03; H01R 11/09; H01R 13/4223; H01R 13/434; H01R 13/4361; H01R 13/447; H01R 13/465
See application file for complete search history.

(56) References Cited

U.S. PATENT DOCUMENTS

| | | | | |
|---|---|---|---|---|
| 6,120,332 | A | 9/2000 | Bertens et al. | |
| 6,332,813 | B1 * | 12/2001 | Okabe | H01R 13/514 439/541.5 |
| 6,452,785 | B1 * | 9/2002 | Kaaden | H01R 9/2658 361/622 |
| 6,626,709 | B2 * | 9/2003 | Cisey | H01R 9/2408 439/701 |
| 2006/0234538 | A1 * | 10/2006 | Khemakhem | H01R 13/518 439/188 |
| 2009/0035983 | A1 * | 2/2009 | Correll | H01R 9/2408 439/460 |
| 2013/0316552 | A1 * | 11/2013 | Sasano | H01R 9/2608 439/122 |
| 2014/0199864 | A1 * | 7/2014 | Devanand | H01R 9/2608 439/116 |
| 2014/0357095 | A1 | 12/2014 | Kute | |
| 2015/0173223 | A1 * | 6/2015 | Binner | H01R 9/2408 174/50 |

FOREIGN PATENT DOCUMENTS

| | | |
|---|---|---|
| EP | 0 141 162 A2 | 9/1984 |
| GB | 1 532 724 | 11/1978 |

* cited by examiner

PATCHBOARD

BACKGROUND OF THE INVENTION

Field of the Invention

The invention relates to a patchboard with multiple socket blocks, whereby the individual socket blocks in each case have a box-shaped housing with two end surfaces and four side surfaces, which extend between the end surfaces, and whereby the two end surfaces of the socket blocks in each case have at least one connecting area.

Description of Related Art

Patchboards are used in particular in places where a number of electrical conductors must be connected in a very tight space. To this end, patchboards are known from experience in which within a solid, rectangular assembly frame, a number of socket blocks are arranged in corresponding chambers of the frame. Electrical conductors can be connected to the patchboard or the individual socket blocks both from the front, the field side, and from the rear, the plant side. To this end, connecting elements are arranged in the box-shaped housings of the individual socket blocks, which elements are in general connected to one another via corresponding busbars, so that an electrical conductor that is inserted through a corresponding conductor inflow opening in the front end surface can be electrically connected to an electrical conductor or to a connecting contact that is inserted through a corresponding inflow opening in the rear end surface of the housing.

Such a patchboard having a number of socket blocks is known from, for example, DE 195 12 226 A1. In the patchboard that is disclosed in this publication, the individual socket blocks, which are inserted into the individual chambers of the assembly frame, all have the same dimensions and the same number and size of conductor inflow openings. On its upper and lower edge sides, in each case a fastening flange base is tightly connected to the patchboard, via which the patchboard can be screwed onto an assembly frame. In addition, clamping modules can be mechanically fastened via dovetail-shaped connections to the fastening flange bases, whereby an electrical connection to the metal assembly frame can be made via a contact plate that is inserted into the bottom of the clamping module. Adapting the patchboard to a user's individual needs is not possible in the case of this known patchboard. If the number of conductors that are to be connected has to be increased, a correspondingly larger patchboard having a larger number of individual socket blocks thus has to be used, whereby in practice, patchboards with 18, 32, 48, 54 or 80 socket blocks are available. For fastening, a different assembly frame that is adapted to the dimensions of the patchboard must then be used.

A patchboard, as it is used in, for example, rolling stock for electrical distribution, is known from DE 10 2013 101 830 A1. Depicted in FIGS. 7 and 8 of this publication are two different assembly frames or distributor housings, in which in each case, a preset number—18 or 54—of chambers is laid out in matrix form, in which in each case a socket block with two conductor inflow openings in the front end surface is arranged. Also, in the case of this patchboard, a fastening flange base is also tightly connected to the patchboard on the upper and lower edge sides of the patchboard, so that the patchboard can be fastened by means of two screws, for example, to a switch cabinet wall. In the case of this patchboard, the production of the individual socket blocks is to be simplified in such a way that the housing has a main housing part and a housing closure part, so that a contact insert having the connecting elements can be easily inserted through an assembly opening in the main housing. Flexible adaptation of the patchboard to a user's individual needs is, however, also not possible here.

SUMMARY OF THE INVENTION

The object of this invention is therefore to make available a patchboard with multiple socket blocks, which are distinguished by an increased flexibility and better adaptability to a user's individual needs.

This object is achieved in the case of the above-described patchboard with the features of Claim 1 in that at least two side surfaces of the socket blocks in each case have at least one latching element for connecting to another socket block, and in that at least one termination element is arranged on at least one side of the patchboard. On at least one side surface, the termination element has at least one mating latching element, by means of which the termination element is connected to an adjacent socket block.

The patchboard according to this invention first has a greater flexibility, so that the individual socket blocks can be directly connected to one another, so that they have in each case at least one latching element on at least two side surfaces, so that the use of a rigid assembly frame that sets the number of individual socket blocks can be eliminated. As a result, the patchboard can have any number of socket blocks, so that the size and the number of poles of the patchboard can be adapted to the respective requirement and, if necessary, can also be easily changed. In the case of the patchboard according to the invention, the flexibility and the number of different possible applications are further increased in such a way that at least one termination element is arranged on at least one side of the patchboard, whereby the termination element can be fastened in a flexible manner to an edge-side socket block of the patchboard by making a mating latching element. The latching connection between the at least one latching element and the at least one mating latching element, made between the termination element and the socket blocks, makes it possible in this case to detachably connect the termination element to the desired position on the patchboard. In this regard, adapting the patchboard to changed requirements is easily possible.

Preferably, on all four side surfaces of the socket blocks, at least one latching element for connecting to another socket block is provided. In this case, the latching elements, which are designed on side surfaces that are opposite to one another, are designed corresponding to one another, so that a socket block can be connected to another socket block both in the x-direction and in the z-direction. The latching elements that correspond to one another in this case can be designed as, for example, latching pins and latching openings, as arms and grooves, in particular as dovetail-shaped arms and corresponding dovetail-shaped grooves or as latching catches and latching projections.

The termination elements have mating latching elements on the side surface facing the socket blocks, which elements correspond to the latching elements of the socket blocks that are provided on the opposite side surface. If the socket blocks on the corresponding side surface have, for example, arms, corresponding grooves are made in the opposite side surface of the termination elements. According to another possible embodiment, in each case at least one arm is made as a latching element on a side surface of the socket block, and at least one groove that corresponds to the arm is made as a mating latching element on the opposite side surface of a termination element. Preferably, in this case, the arms and the grooves in each case have dovetail-shaped cross-sections that correspond to one another.

In the case of the patchboard according to the invention, the cross-sectional dimensions of a termination element can correspond to the cross-sectional dimensions of a socket block; in particular, a termination element can have the same width as a socket block. In addition, however, the possibility also exists that the patchboard has a termination element that has a greater width than a socket block. Thus, in this case also, the termination element can be easily connected to edge-side socket blocks if the termination element has a width $W_A$ that is a whole multiple of the width $W_W$ of a socket block. The latching of such a termination element with multiple socket blocks is in this case ensured in such a way that the number of mating latching elements of the termination element is a corresponding multiple of the number of latching elements of a socket block. In the case of a double-wide termination element in comparison to the width of a socket block, the termination element on its side surface facing the socket block thus has a double number of mating latching elements in comparison to the number of corresponding latching elements of an individual socket block. A double-wide termination element can thus be easily fastened to two single-wide socket blocks.

Because of the configuration of the patchboard according to the invention, there exists not only the possibility of arranging a termination element, if necessary, in different positions of the patchboard, but also the possibility of connecting different termination elements to the edge-side socket blocks, if necessary. By selecting suitable termination elements, the patchboard can thus be adapted to different requirements in a simple way, so that a customer's varying needs can be met.

The termination elements can be designed, for example, in such a way that they are used to fasten the patchboard to a wall, for example a switch cabinet wall. To this end, a termination element preferably has at least one fastening area with at least one opening, through which a fastening element, for example a screw, can be passed.

As an alternative or in addition, the termination element can also have a marking area for identifying the patchboard or an area of the patchboard. The marking area in this case can be either directly inscribed or the marking area has at least one guide groove, in which a corresponding identifying sign can be engaged. Preferably, the marking area has two guide grooves on two sides that are arranged perpendicular to one another, so that the inscription or identification of the patchboard from two different directions of view is easily ensured.

According to an additional configuration of the invention, a termination element that is used for fastening can also be designed as a snap-on foot for latching the patchboard to a support rail, whereby the termination element then has two latching legs that are opposite one another and that accommodate the support rail in a clamping manner in between. Using such a termination element that is fastened to the patchboard, the patchboard can then be fastened in a detachable manner to a support rail. Depending on the size of the patchboard, in this case even more than one snap-on foot, in particular two snap-on feet, can be used.

A termination element can also be designed as an equalization element according to another advantageous configuration of the invention, so that the outside dimensions of the patchboard can be adapted to a specific installation dimension that is provided by a customer. Such a termination element that is designed as an equalization element can in this case be used in particular for adapting the overall height of the patchboard to a preset installation height, and therefore the equalization element can be fastened to the upper side and/or to the lower side of the patchboard.

Such a termination element that is designed as an equalization element in this case preferably has at least one arm on its side surface and at least one groove on the opposite side surface, so that the termination element can be fastened both to the top of the patchboard and to the bottom of the patchboard on the edge-side socket blocks. Moreover, such a configuration of the termination element having at least one arm on a side surface and at least one groove on the opposite side surface offers the possibility that another termination element, for example a termination element that is provided for fastening, can be attached on the side surface of the termination element that faces away from the edge-side socket block. Furthermore, such an equalization element can then also be arranged within the patchboard, for example between two rows of socket blocks. Also, as a result, adapting the overall height of the patchboard to a preset installation dimension by selecting a correspondingly dimensioned termination element is easily possible, without the individual socket blocks having to be changed.

According to another configuration of the invention, in each case a termination element is arranged on two opposite sides of the patchboard, whereby the two termination elements are designed in such a way that they make possible a pivotable fastening of the patchboard. To this end, the two termination elements preferably in each case have a connecting area, a holding area, and a fastening area with at least one opening. The at least one mating latching element of the termination element is in this case made on the connecting area, so that the latter is connected in the mounted state having at least one, preferably a number of, edge-side socket block(s). The connecting area is connected via a swivel axis to the holding area, which is arranged in a perpendicular manner to the fastening area. The holding area and the fastening area thus form a fastening angle that can be attached by means of screws, which are inserted through the openings in the fastening area, to a wall, for example to a switch cabinet wall.

In the case of another configuration, the termination element has a connecting area and a conductor guide area, whereby even in the case of this variant of the termination element, the at least one mating latching element is made on the connecting area. The conductor guide area that is made preferably in an integral manner with the connecting area projects when mounted over the front end surface of the socket blocks, so that the conductors that are to be connected to the socket blocks can be fastened to the conductor guide area. The fastening of the conductors that are to be connected to the conductor guide area can be done, for example, using cable ties, by which traction relief of the conductors that are to be connected is also ensured. As an alternative, the conductor guide area can also have multiple clamping sections for clamping individual conductors, so that also in this regard, both a guide and traction relief of the connected conductors are provided.

More specifically, there are now a considerable number of possibilities to configure and to further develop the patchboard according to the invention and the individual socket blocks as will be apparent from the following description of preferred embodiments in connection with the drawings.

DETAILED DESCRIPTION OF THE INVENTION

Figure 1:
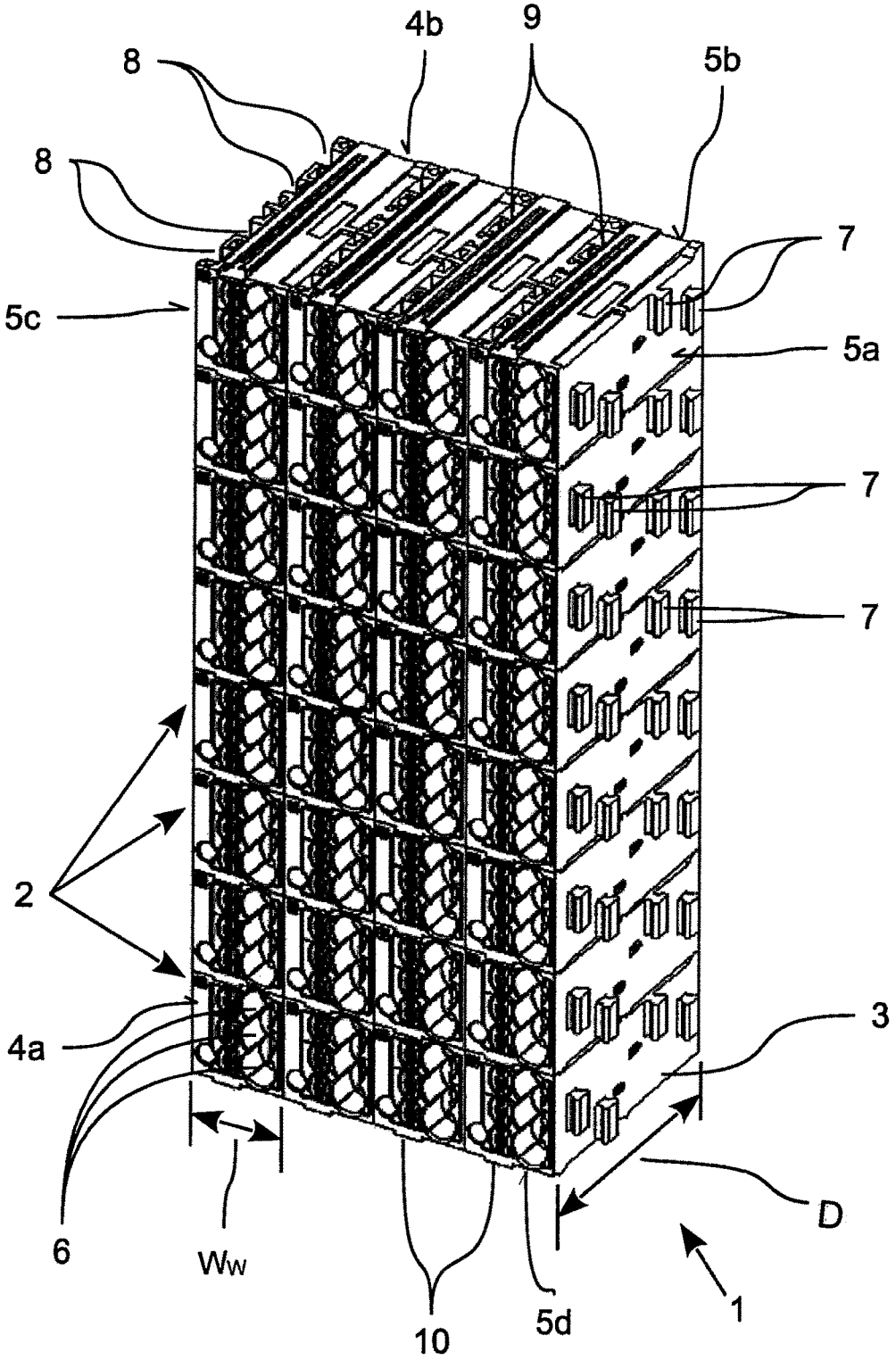
FIG. 1 shows an embodiment of a patchboard that is built up from a number of socket blocks.

FIG. 1 shows an embodiment of a patchboard 1, which has a number of socket blocks 2, whereby the individual socket blocks 2 are connected to one another directly. The patchboard 1, which consists of 32 socket blocks 2 overall, thus does not have any solid assembly frames, into whose individual chambers the individual socket blocks 2 are inserted, so that the number of individual socket blocks 2 and thus also the dimensions of the patchboard 1 can be flexibly adapted to the respective requirements of a user.

The individual socket blocks 2 in each case have a box-shaped housing 3 with front and rear end surfaces 4*a*, 4*b* and four side surfaces 5*a*, 5*b*, 5*c*, and 5*d*. In this case, the individual side surfaces 5*a*, 5*b*, 5*c*, 5*d* extend between the front and rear end surfaces 4*a*, 4*b* and in each case have an angle of 90° with respect to the front and rear end surfaces 4*a*, 4*b*. The socket block 2 thus has a rectangular cross-section, having a width W and a height H. Furthermore, the socket blocks 2 have a length or depth D. In the depicted patchboard 1, all socket blocks 2 have the same dimensions, without the invention, however, being limited thereto. In the depicted socket blocks 2, the dimensions W×H×D are, for example, 12 mm×11 mm×30 mm, whereby these dimensions are also by no means limiting.

On the front end surface 4*a* of the socket blocks 2, in each case three connecting areas 6, which are preferably designed as spring-force clamping connections, are provided. Within the housing 3, three clamping springs are arranged, whereby by means of the clamping springs, a conductor, stripped of insulation, that is inserted through a respective conductor inflow opening of a connecting area 6, can be clamped against a busbar, also arranged in the housing 3, and thus can be connected in an electrically conductive manner to the busbar. The rear end surface 4*b* can also have three connecting areas. In addition, it is also possible, however, that the front and rear end surfaces 4*a*, 4*b* have a different number of connecting areas; the rear surface 4*b*, for example, has only two connecting areas.

To connect the socket blocks below one another, the socket blocks 2 on all four side surfaces 5*a*, 5*b*, 5*c*, 5*d* have at least one latching element. As a result, a socket block 2 can be connected on all four of its side surfaces 5*a*, 5*b*, 5*c*, 5*d*, and thus both in the x-direction and in the z-direction, to another socket block 2, in order to form a patchboard 1, as it is depicted in, for example, FIG. 1.

The socket blocks 2 in each case have four dovetail-shaped arms 7 on the first side surface 5*a*, to which arms grooves 8 that correspond to the side surface 5*c* of a socket block 2 that is opposite to the side surface 5*a* are made, which grooves also have a dovetail-shaped cross-section. As a result, two socket blocks 2 can be connected to one another in the x-direction by the arms 7, arranged on the side surface 5*a* of the one socket block 2, being inserted into the grooves 8 made on the side surface 5*c* of the adjacent socket block 2.

In each case, a groove 9, which extends approximately over the entire depth D of a socket block 2, is made on the upper side surface 5*b* of the housing 3. Corresponding to the groove 9, an arm 10 is made in each case on the lower side surface 5*d* of the socket blocks 2, so that two socket blocks 2 can also be arranged in the z-direction one above the other by the arm 10 on the lower side surface 5*d* of an upper socket block 2 being inserted into the groove 9 on the upper side surface 5*b* of a lower socket block 2.

Figure 2A:
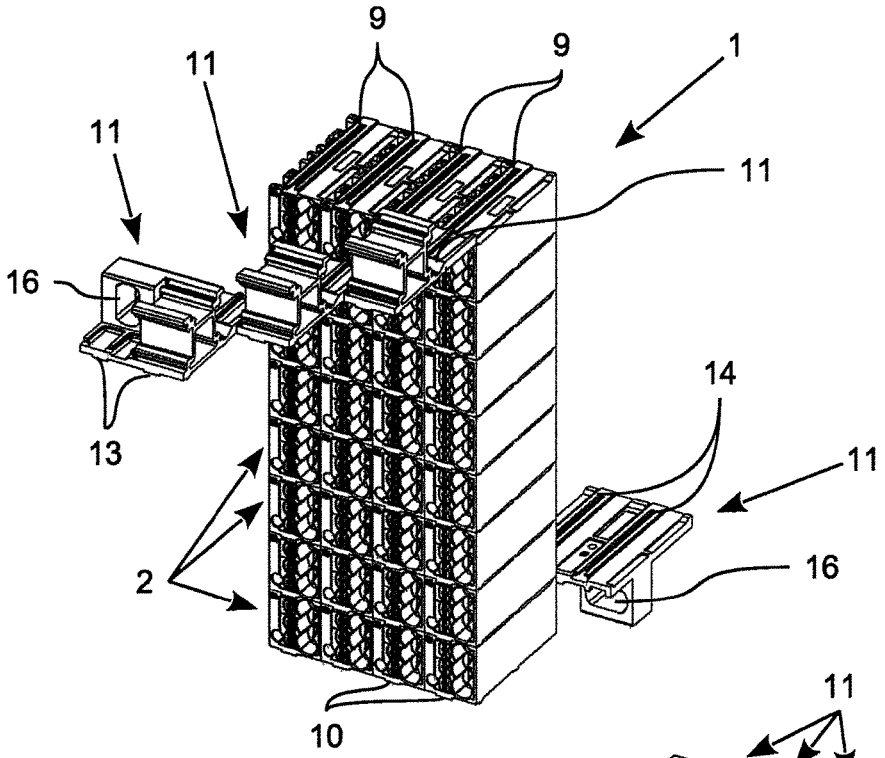
FIG. 2 shows the patchboard according to FIG. 1 having multiple termination elements, in the still unmounted state and in the mounted state.
Figure 2B:
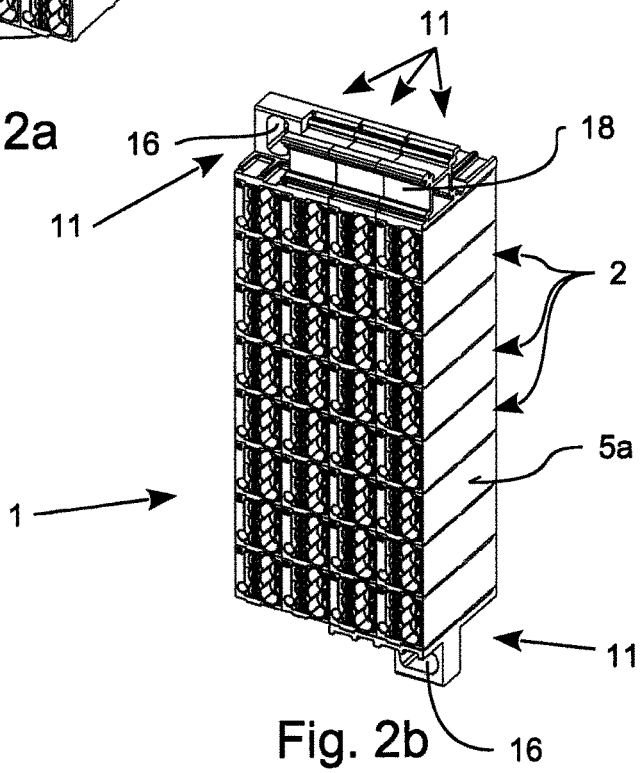
Figure 3A:
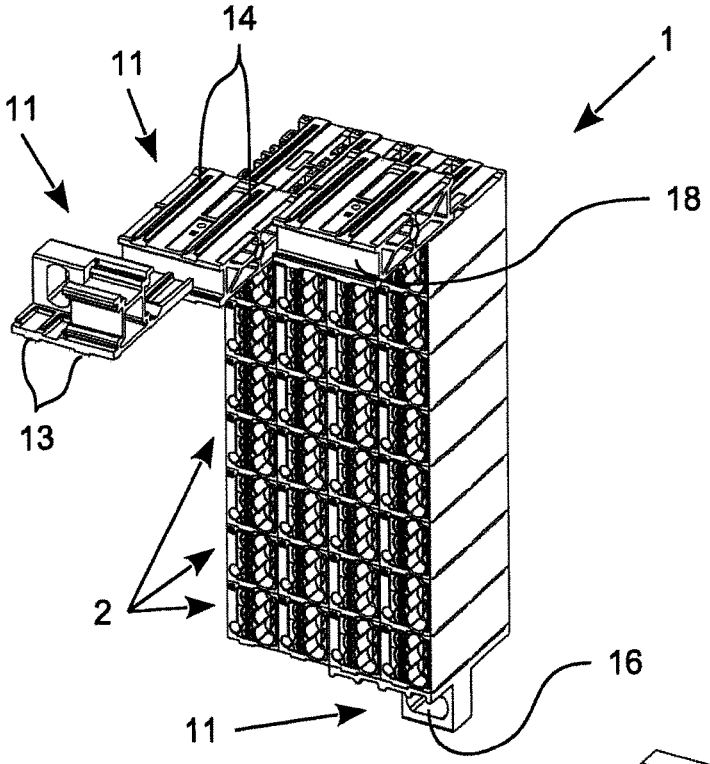
FIG. 3 shows the patchboard according to FIG. 1 with additional termination elements, in the still unmounted state and in the mounted state.
Figure 3B:
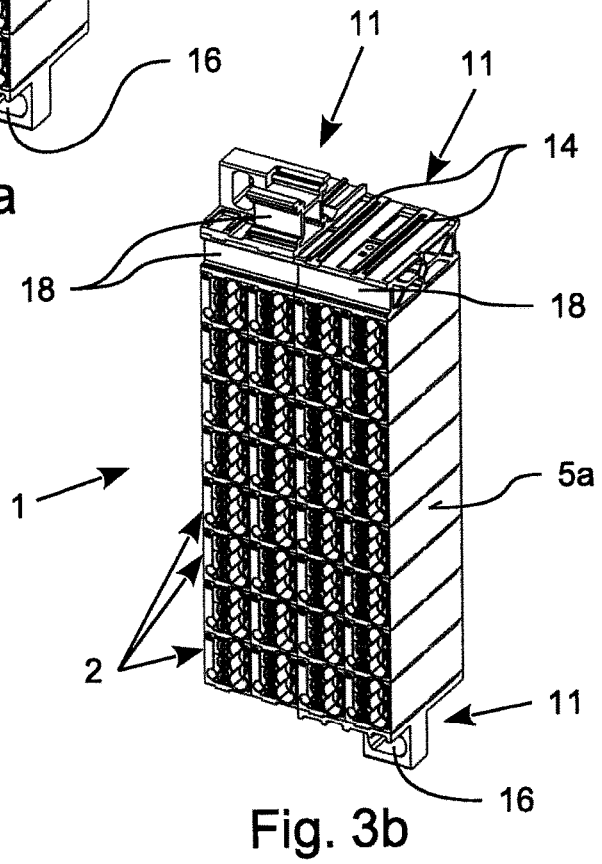

FIGS. 2 and 3 show the patchboard 1 according to FIG. 1 together with multiple termination elements 11, in each case once with not yet completely mounted termination elements 11 and once with mounted termination elements 11. In the depicted embodiments, termination elements 11 are provided both on the upper side and on the lower side of the patchboard 1, whereby the fastening of the termination elements 11 to the adjoining, edge-side socket blocks 2 is carried out in such a way that the termination elements 11 have mating latching elements at least on the side surface 12*a* that is opposite to the adjoining socket blocks 2, which mating latching elements correspond to the latching elements of the socket blocks 2. As a result, the termination elements 11 can be easily fastened to the edge-side socket blocks 2 and also detached again from the socket blocks 2, if necessary.

As FIGS. 2 and 3 show, the patchboard 1 can be connected, if necessary, to different termination elements 11, so that a patchboard 1 that corresponds to the respective requirements can be made available. In contrast to the patchboard 1 that is depicted in FIG. 1, the socket blocks 2 that form the right side edge of the patchboard 1 do not have any latching elements on their side surface 5*a*, so that no additional socket blocks 2 can be fastened to this side. In principle, however, even in the case of the patchboards 1 that are depicted in FIGS. 2 and 3, the socket blocks 2 that form the right side edge of the patchboard 1 can also have latching elements on their side surfaces 2, as is depicted in the case of the patchboard 1 according to FIG. 1.

In the case of the embodiment of the patchboard 1 that is depicted in FIGS. 2*a* and 2*b*, the three termination elements 11, which are connected to the upper socket blocks 2, in each case have at least one arm 13 on their side surface 12*a* that faces the socket blocks 2, which arm can be inserted into the groove 9 that is made on the side surface 5*b* of the socket block 2. The termination element 11, which is connected to the lower, edge-side socket blocks 2, however, has two grooves 14 on its side surface 12*a* that faces the socket blocks 2, which grooves can be connected to the corresponding arms 10 on the side surface 5*d* of two adjacent socket blocks 2. This termination element 11, which is used to fasten the patchboard 1, for example, to a switch cabinet wall, is also depicted separately in FIG. 5*a*. This shows that the termination element 11 has a fastening area 15 with an opening 16 through which a screw, not depicted here, passes and can be screwed into a corresponding hole in a switch cabinet wall.

Figure 5A:
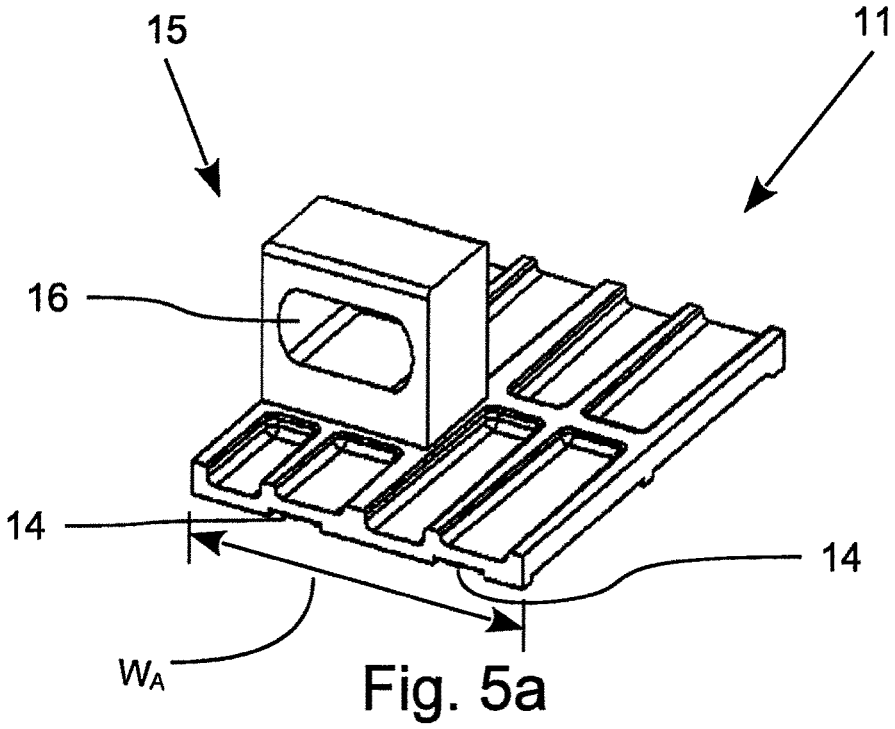
FIG. 5 shows two embodiments of a termination element that is used for fastening.
Figure 5B:
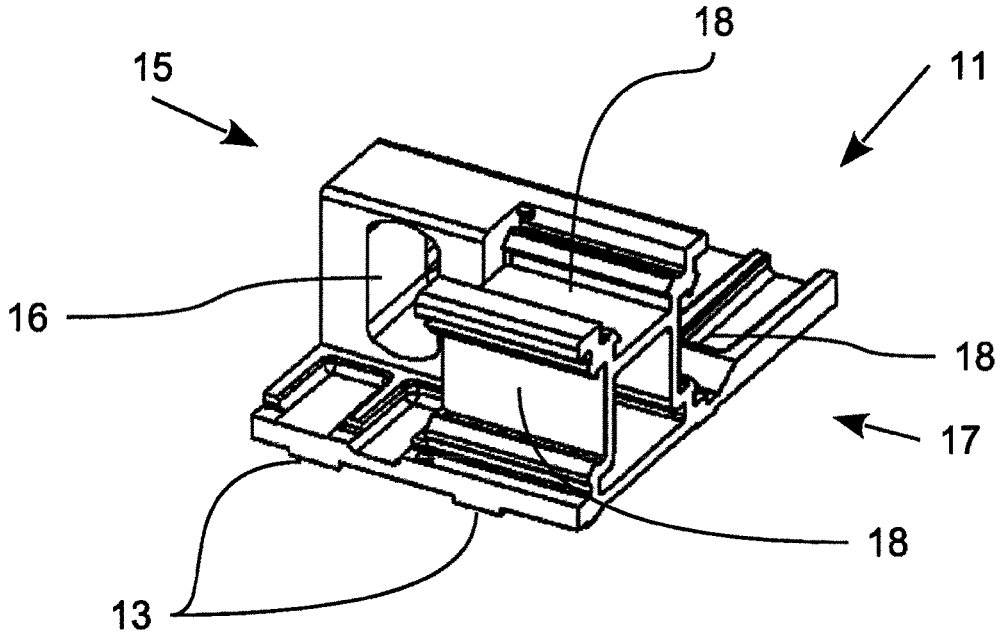

The upper left termination element 11 that is depicted in FIG. 2 is also depicted separately in FIG. 5*b*. This termination element 11 is also used in the fastening of the patchboard 1, so that it also has a fastening area 15 having an opening 16. In order to facilitate the fastening of the patchboard 1 to, for example, a switch cabinet wall, in which holes are already provided for the screws to pass through the opening, the openings 16 made in the fastening areas 15 are made in each case as longitudinal openings, whereby the longitudinal axes of the two openings 16 are oriented perpendicular to one another.

In the case of the termination element 11 that is depicted in FIG. 5*b*, a marking area 17 is also provided in addition to the fastening area 15, which marking area has two guide grooves 18, which are made on two side surfaces that are arranged perpendicular to one another. In the two guide grooves 18, in each case a marking sign can be engaged for marking the patchboard 1 or an area of the patchboard 1. In the case of the termination element 11 that is depicted in FIG. 5*b*, the marking area 17 in addition has a third guide groove 18, in which a corresponding identifying sign can also be engaged. This guide groove 18 is arranged in such a way that an engaged identifying sign can be read from the rear of the patchboard 1, the plant side.

Figure 6:
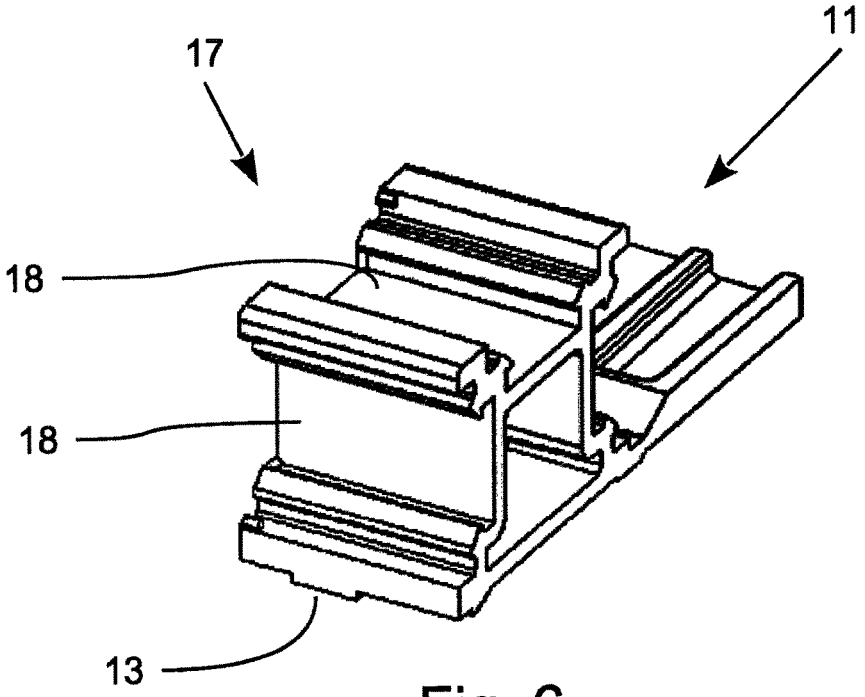
FIG. 6 shows an embodiment of a termination element that is used for identification.

In the case of the patchboard 1 that is depicted in FIG. 2, two more termination elements 11, which are used exclusively to the marking, are also provided on the top. Such a termination element 11 is depicted separately in FIG. 6. The termination element 11 has a marking area 17, on which a total of three guide grooves 18 are made. It can be seen from FIG. 2 as well as from a comparison of the two termination elements 11 that are depicted in FIGS. 5*a* and 5*b* having the termination element 11 that is depicted in FIG. 6 that the termination elements 11 that are depicted in FIG. 5 have a width $W_A$ that is twice as large as the width $W_W$ of a socket block 2. So that these termination elements 11 can be connected to the socket blocks 2, they have a double number of mating latching elements, namely two grooves 14 (FIG. 5*a*) or two arms 13 (FIG. 5*b*), in comparison to the number of latching elements, namely a groove 9 or an arm 10 of the socket blocks 2.

Figure 7:
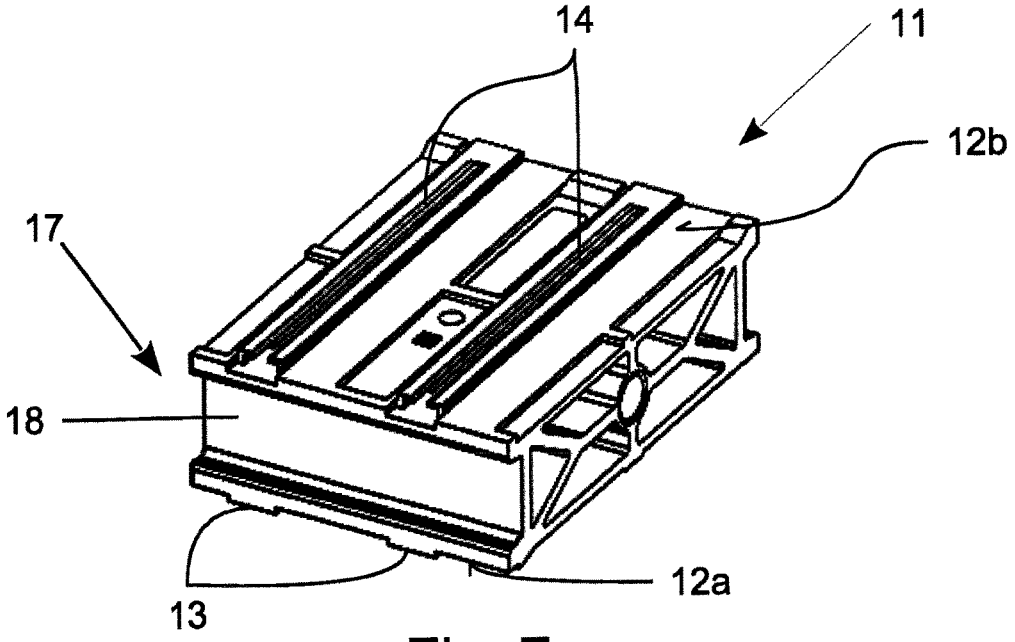
FIG. 7 shows an embodiment of a termination element that is designed as an equalization element.

The patchboard 1 that is depicted in FIG. 3 is distinguished from the patchboard 1 that is depicted in FIG. 2 in such a way that the termination element 11 that is used for fastening and marking and that is depicted separately in FIG. 5*b* is not connected directly to the upper, edge-side socket blocks 2. In the case of this embodiment, two termination elements 11 that are used as equalization elements and that are depicted separately in FIG. 7 are also provided. In the case of the termination element 11 according to FIG. 7 that is used here as a height equalization element, two arms 13 are made on the side surface 12*a* that faces the socket blocks 2 and two grooves 14 are made on the opposite side surface 12*b*. As a result, this termination element 11 can be connected via the arms 13 to two upper, edge-side socket blocks 2 and via the grooves 14 to one or two additional termination elements 11, for example to the termination elements 11 that are depicted in FIG. 5. FIG. 3 shows that also here, as in the embodiment according to FIG. 2, two termination elements 11 according to FIG. 6 that are used for marking could also be fastened to the second right termination element 11 that is used as a height equalization element.

Figure 4:
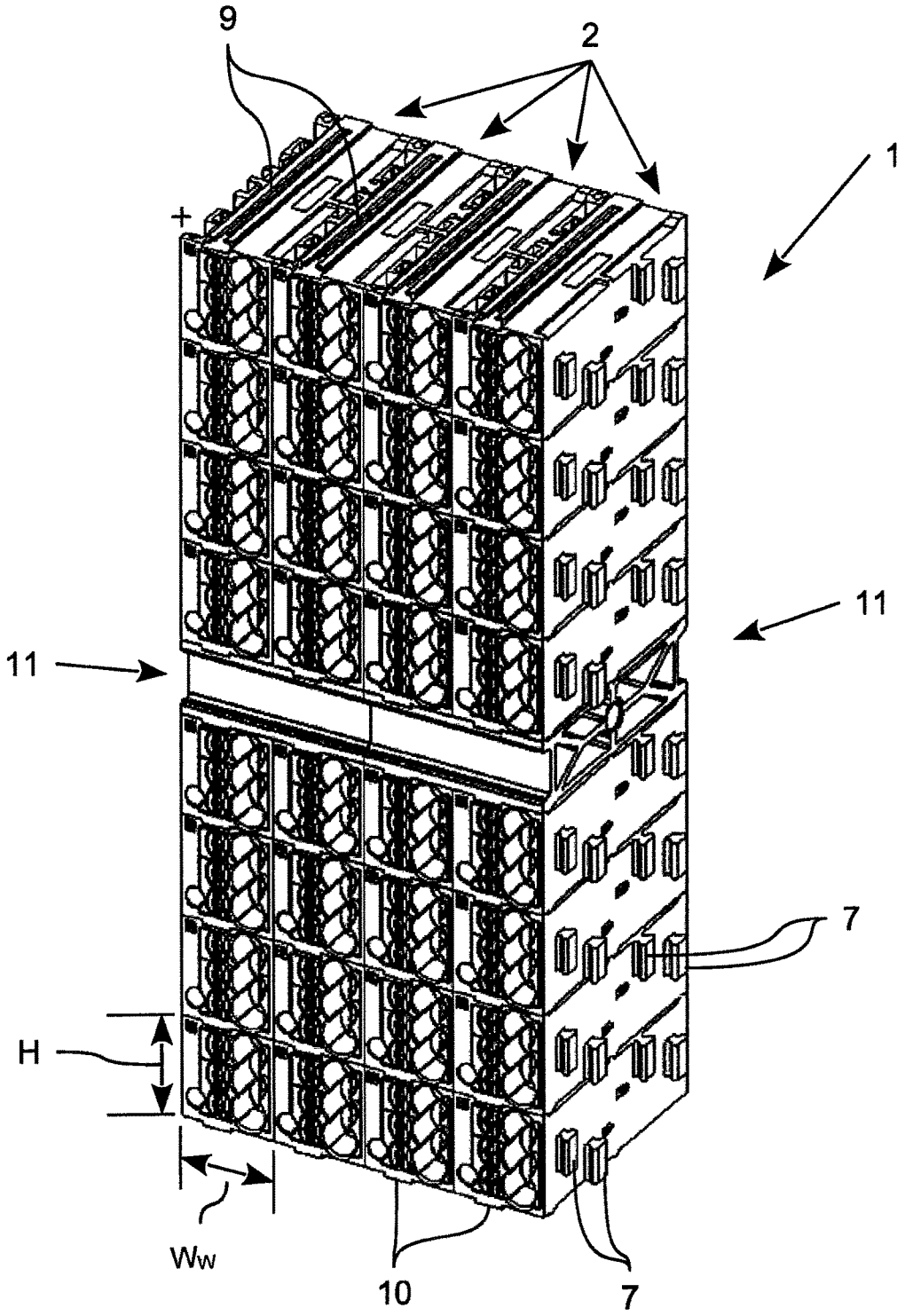
FIG. 4 shows a patchboard that is similar to the patchboard according to FIG. 1, with two termination elements that are designed as equalization elements.

A patchboard 1 is depicted in FIG. 4, which—just like the patchboard 1 that is depicted in FIGS. 1 to 3—has a total of 32 socket blocks 2. Moreover, the patchboard 1 that is depicted in FIG. 4 also has two termination elements 11 that are used as height equalization elements, which, however, unlike the embodiment according to FIG. 3, are not arranged on the upper side of the patchboard 1 but rather in the center of the patchboard 1, i.e., between two rows of socket blocks 2. The two termination elements 11 that are used in the case of the patchboard 1 according to FIG. 4 correspond in this case to the termination element 11 that is depicted separately in FIG. 7.

Figure 8A:
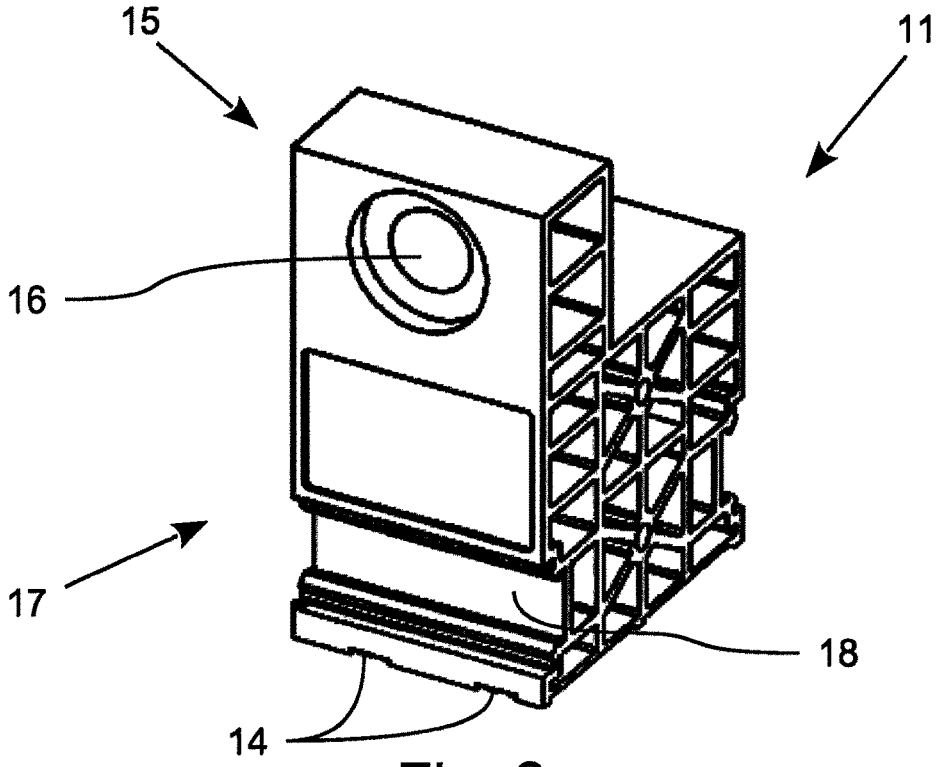
FIG. 8 shows two embodiments of a termination element that is used for fastening and for identification.
Figure 8B:
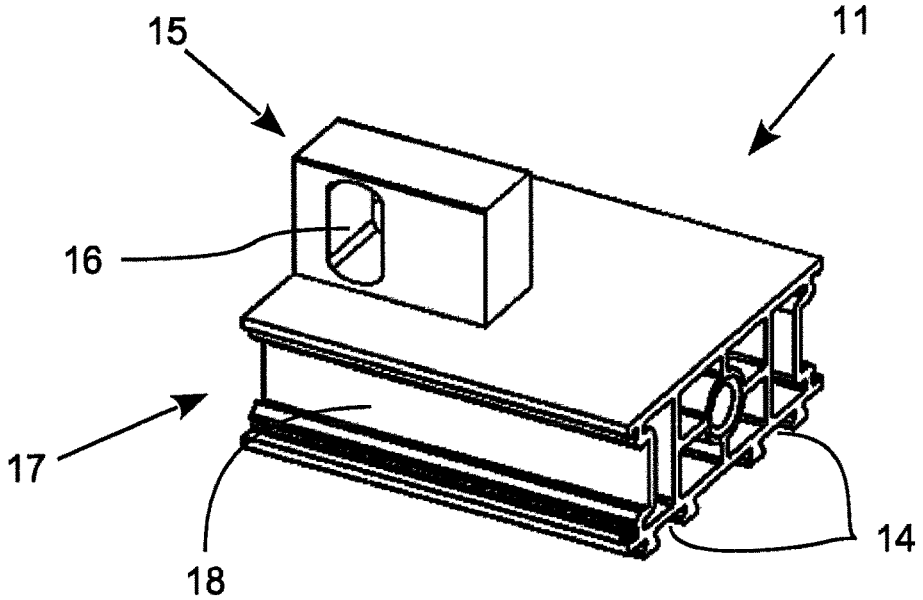

In FIG. 8, two additional embodiments of a termination element 11 are depicted, which in each case are used for fastening and marking a patchboard 1. The two termination elements 11 in each case have a fastening area 15 having an opening 16 and a marking area 17 having a guide groove 18 for an identifying sign. As can be seen in particular from a comparison of the two termination elements 11 that are depicted in FIGS. 8*a* and 8*b* having the termination element 11 that is depicted in FIG. 5*b*, the termination elements 11 that are depicted in FIG. 8 are also used as height equalization. This is achieved in particular in that the fastening area 15 and the marking area 17 are not—as in the execution part according to FIG. 5*b*—arranged beside one another but rather above one another. By a corresponding sizing of a termination element 11 that is used as an equalization element, it is thus possible in a simple way to adapt a patchboard 1, which has a specific number of socket blocks 2, to a specific installation dimension.

Figure 9:
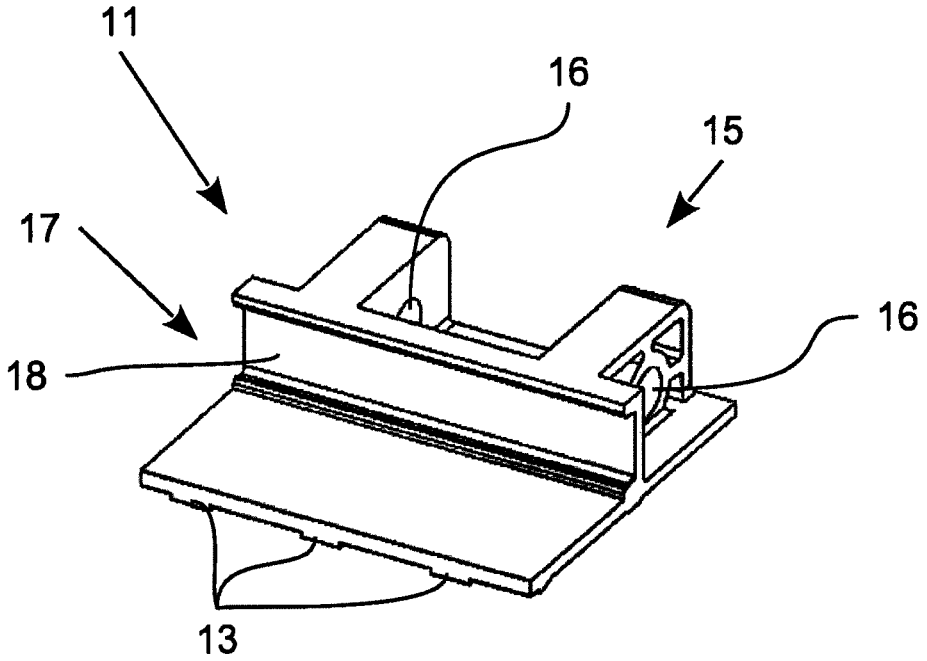
FIG. 9 shows another embodiment of a termination element that is used for fastening and for identification.
Figure 10:
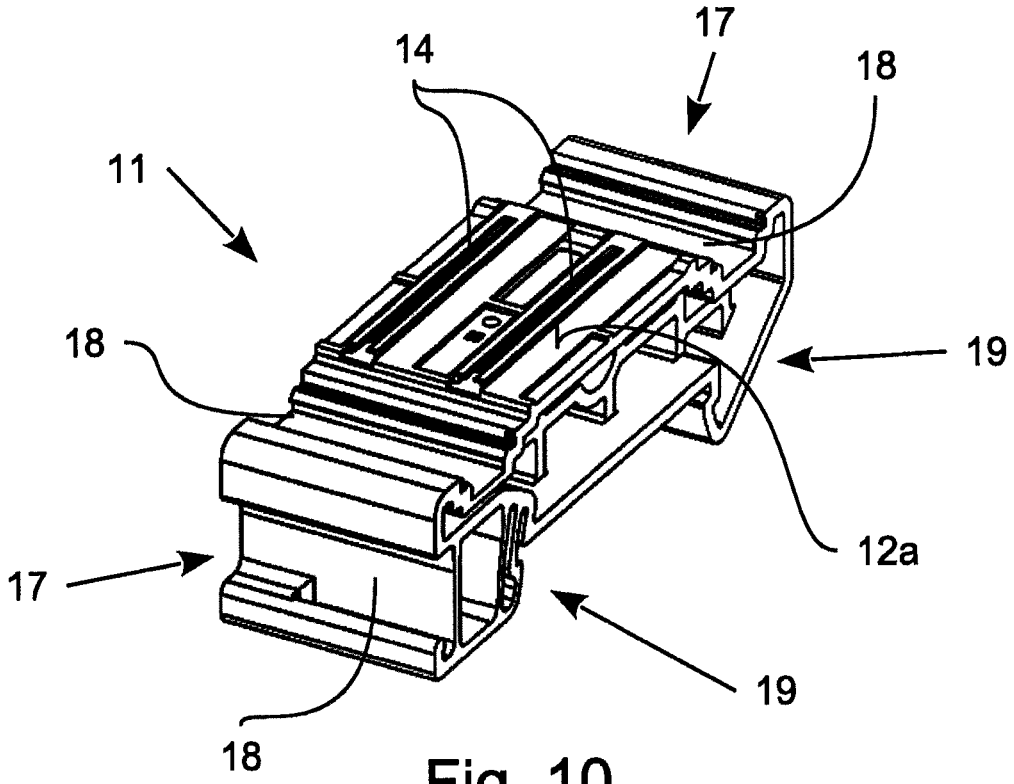
FIG. 10 shows an embodiment of a termination element that is designed as a catch foot.

FIGS. 9 and 10 show two additional embodiments of a termination element 11, which is used for fastening and marking a patchboard 1. The termination element 11 that is depicted in FIG. 9 has a fastening area 15 with two openings 16, through which a rod can be pushed, so that the fastening element 11 and, with the latter, also a patchboard 1 can be fastened to a corresponding rod. Since the termination element 11 that is depicted in FIG. 9 has a width that is three times as large as the width of a single socket block 2, the termination element 11 has three arms 13 on its side surface 12*a* that faces the socket blocks 2, which arms can be pushed into the grooves 9 on the upper side surface 5*b* of three socket blocks 2 that are arranged beside one another.

The termination element 11 that is depicted in FIG. 10 is designed as a snap-on foot for latching onto a support rail, and therefore the termination element 11 has two latching legs 19, between which the support rail can be clamped. On its side surface 12*a* that faces the socket blocks 2, this termination element 11 has two grooves 14, into which the arms 10 that are made on the lower side surface 5*d* of two adjacent socket blocks 2 can be pushed.

The two termination elements 11 that are depicted in FIGS. 9 and 10 are also used, moreover, for identifying a patchboard 1, and therefore the termination element 11 according to FIG. 9 has a marking area 17 with a guide groove 18. The termination element 11 according to FIG. 10 that is designed as a snap-on foot has two marking areas 17, whereby two guide grooves 18 are made on the front marking area 17 and a guide groove 18 is made on the rear marking area 17.

Figure 11:
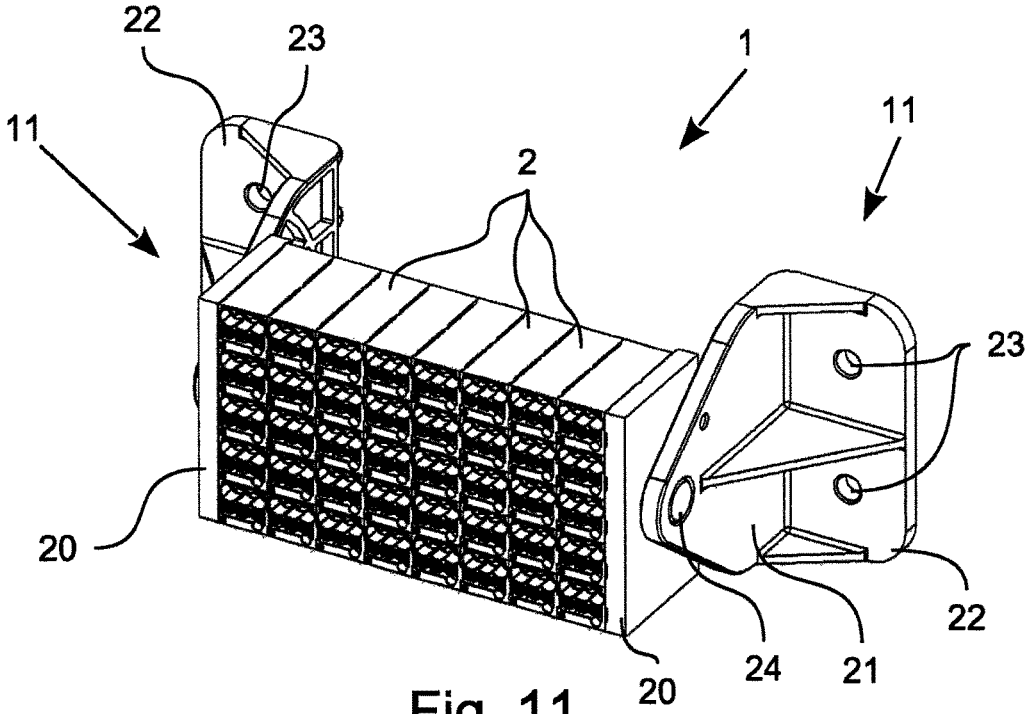
FIG. 11 shows an embodiment of a patchboard that is fastened in a pivotable manner.

FIG. 11 shows another embodiment of a patchboard 1, in which in each case, a termination element 11 is arranged on two sides that are opposite to one another. Using the two termination elements 11, the patchboard 1 can be fastened to, for example, a switch cabinet wall, whereby the two termination elements 11 are designed in such a way that the patchboard 1 can be swiveled when mounted. To this end, the two termination elements 11 in each case have a connecting area 20, on which the mating latching elements are made. The connecting areas 20 are thus connected in a detachable manner to the edge-side socket blocks 2 of the patchboard 1 via the mating latching elements and the latching elements that are made on the socket blocks 2. Moreover, the two termination elements 11 in each case also have a holding area 21 and a fastening area 22, which are arranged perpendicular to one another, so that they form a fastening angle together. In the fastening area 22, two openings 23 are made, which openings are used to accommodate screws with which the termination elements 11 can be fastened to a wall. The previously-cited swivelable arrangement of the patchboard 1 is ensured in that the two connecting areas 20 in each case are connected via a swivel axis 24 to the respective holding area 21 of the termination element 11.

Figure 12:
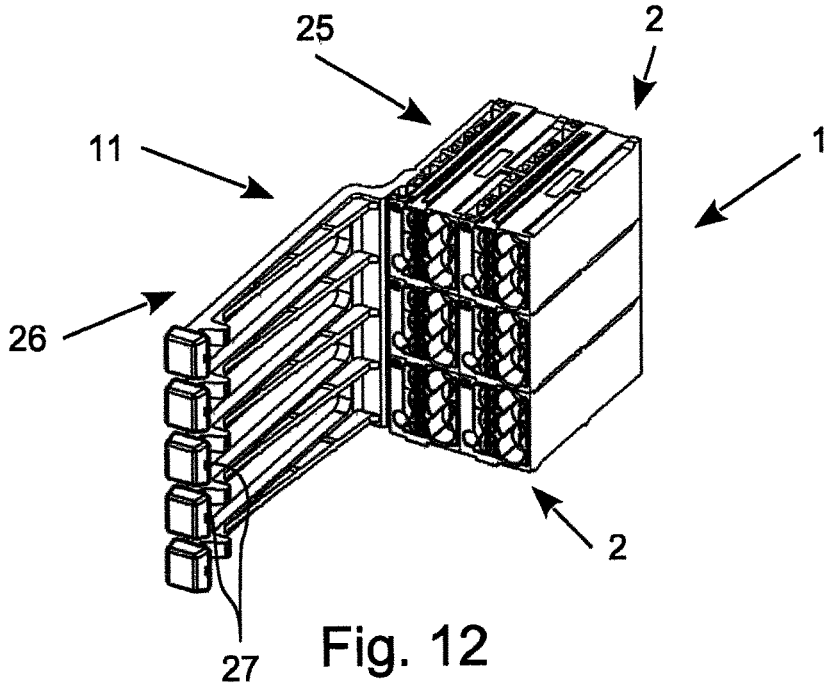
FIG. 12 shows a patchboard with a termination element that is used for guiding conductors.

Finally, FIG. 12 shows an embodiment of a patchboard 1, which has only six socket blocks 2. In addition, this patchboard 1 also has a termination element 11, which is used to guide and hold the conductor that is to be connected to the socket block 2. To this end, the termination element 11 has a connecting area 25 and a conductor guide area 26. In this case, multiple arms are made on the connecting area 25, which arms engage with the grooves 8 made on the side surface 5*c* of the adjoining socket blocks 2. The conductor guide area 26 that is made in an integral manner with the connecting area 25 projects over the front end surface 4*a* of the socket blocks 2, so that the conductors that are to be connected can be fastened to the conductor guide area 26. To this end, multiple clamping sections 27 for clamping the individual conductors are made on the conductor guide area 26, by which traction relief of the connected conductors can also be achieved.

What is claimed is:

1. A patchboard comprised of multiple socket blocks, wherein individual ones of the socket blocks each have a box-shaped housing with front and rear end surfaces and four side surfaces, which extend between the front surfaces, and wherein the front and rear end surfaces of the socket blocks in each case have at least one connecting area, wherein:

at least two side surfaces of the socket blocks each have at least one latching element for connecting to another socket blocks, at least one termination element is arranged on at least one side of the patchboard, and the at least one termination element has a mating latching element on at least one side surface, by means of which mating latching element the termination element is connected to an adjacent socket block, wherein a termination element is structured as an equalization element, and at least one arm is formed on a side surface of the termination element, and at least one first groove is formed on an opposite side surface of the termination element.

2. The patchboard according to claim 1, wherein in each socket block has a groove that is formed as a latching element on a side surface of the socket block, and at least one arm that corresponds to the groove on a side surface of the socket block is formed as a mating latching element on an opposite side surface of the termination element.

3. The patchboard according to claim 1, wherein in each case, at least one arm is formed as a latching element on a side surface of at least one of the socket blocks, and at least one groove that corresponds to the arm on a side surface of the socket block is formed as a mating latching element on an opposite side surface of the termination element.

4. The patchboard according to claim 1, wherein the termination element has a width $W_A$, which a is whole integer multiple of a width $W_W$ of at least one of the socket blocks, and wherein the number of mating latching elements of the termination element is a corresponding whole integer multiple of the number of latching elements of the at least one of the socket blocks.

5. The patchboard according to claim 1, wherein the termination element has at least one fastening area having at least one opening.

6. The patchboard according to claim 1, wherein the termination element has a marking area with at least one guide groove.

7. The patchboard according to claim 6, wherein the marking area has two guide grooves on two sides of the marking area that are arranged perpendicular to one another.

8. The patchboard according to claim 1, wherein the termination element is a snap-on foot for latching on a support rail and has two opposite latching legs.

9. The patchboard according to claim 1, wherein the multiple socket blocks are arranged in two directions of the patchboard that are different from one another and are connected to one another, and in each socket block, at least one termination element is arranged on two sides of the patchboard.

10. A patchboard comprised of multiple socket blocks, wherein individual ones of the socket blocks each have a box-shaped housing with front and rear end surfaces and four side surfaces, which extend between the front and rear end surfaces, and wherein the front and rear end surfaces of the socket blocks in each case have at least one connecting area, wherein:

at least two side surfaces of the socket blocks each have at least one latching element for connecting to another socket block, at least one termination element is arranged on at least one side of the patchboard, and the at least one termination element has a mating latching element on at least one side surface, by means of which mating latching element the termination element is connected to an adjacent socket block, wherein at least two termination elements are provided, and, in each case, the at least two termination elements are arranged on two opposite sides of the patchboard, wherein the two termination elements each have a connecting area, a holding area and a fastening area having at least one opening, such that the at least one mating latching element is formed on the connecting area, the connecting area is connected via a swivel axis to the holding area, and the holding area is arranged perpendicular to the fastening area.

11. The patchboard according to claim 10, wherein the multiple socket blocks are arranged in two directions of the patchboard that are different from one another and are connected to one another, and in each socket block, at least one termination element is arranged on two sides of the patchboard.

12. A patchboard comprised of multiple socket blocks, wherein individual ones of the socket blocks each have a box-shaped housing with front and rear end surfaces and four side surfaces, which extend between the front and rear end surfaces, and wherein the front and rear end surfaces of the honeycomb components in each case have at least one connecting area, wherein:

at least two side surfaces of the socket blocks each have at least one latching element for connecting to another socket block, at least one termination element is arranged on at least one side of the patchboard, and the at least one termination element has a mating latching element on at least one side surface, by means of which mating latching element the termination element is connected to an adjacent socket block, wherein the termination element has a connecting area and a conductor guide area, such that the at least one mating latching element is formed on the connecting area, and the conductor guide area projects over a front surface of the socket block.

13. The patchboard according to claim 12, wherein the conductor guide area has multiple clamping sections for clamping individual conductors.

* * * * *